United States Patent [19]

Shoemaker, Jr.

[11] 4,272,082

[45] Jun. 9, 1981

[54] COIN PROJECTING AMUSEMENT DEVICE

[76] Inventor: Stephen P. Shoemaker, Jr., 70 Tenth St., Hermosa Beach, Calif. 90254

[21] Appl. No.: 83,376

[22] Filed: Oct. 10, 1979

[51] Int. Cl.[3] ..... A63F 7/28; A63F 7/30

[52] U.S. Cl. ..... 273/356; 194/DIG. 11; 273/379

[58] Field of Search ..... 273/351, 354, 355, 356, 273/357, 379; 194/DIG. 11, 1 K

[56] References Cited

U.S. PATENT DOCUMENTS 4,240,536 12/1980 Noell, Jr. ..... 194/1 K

FOREIGN PATENT DOCUMENTS 1131596 10/1968 United Kingdom ..... 194/DIG. 11

*Primary Examiner*—Anton O. Oechsle

*Attorney, Agent, or Firm*—Bruno J. Verbeck; Michael L. Slonecker

[57] ABSTRACT

An amusement device wherein coins may be controllably deposited upon a surface having a multiplicity of surface interruption means thereon. A vertical dam synchronously translates over at least a portion of said surface and pushes said deposited coins against an accumulated random pattern of like coins, thereby causing some of said accumulated coins to fall over an edge into collecting and counting means.

4 Claims, 3 Drawing Figures

COIN PROJECTING AMUSEMENT DEVICE

BACKGROUND OF THE INVENTION

The present invention relates to amusement devices, and more particularly to coin pitching devices of the mechanical kind such as that disclosed in my pending joint application for U.S. Pat. Ser. No. 965,876 filed Dec. 4, 1978, wherein a synchronously translating dam urges coins, controllably deposited by a player, against a random pattern of like coins accumulated upon a substantially flat surface.

As representative example of the prior art, there exists a device known as "Penny Falls" which is manufactured in England by the Crompton Company. Briefly stated, "Penny Falls" comprises a substantially rectangular housing having an upper surface over which a dam synchronously translates sideways to a player. A gimbaled coin chute is deployed over said surface and aligned substantially parallel to said dam, thereby permitting the player to deposit coins upon at least a portion of the swept area of said surface. A multiplicity of plano-convex members are disposed upon a major portion of the unswept area of said surface, said members portruding above the upper surface a distance sufficient to permit the coins to translate over said members. Since these protrudng members further randomize coin movement by imparting multidirectional forces thereto, said members may obscure the ability of a player to determine the outcome of a particular play.

As sufficient coins accumulate upon the upper surface, certain numbers of them are caused to fall over the edge of said housing opposite the dam wherein they are counted and a payoff dispensed to the player. However, "Penny Falls" further permits certain numbers of coins to fall from the edges of said housing proximate said opposite edge, these coins representing a "house" percentage for which no payoff is dispensed to the player. Thus, even though a player may be able to skillfully manipulate coins to preferred areas of the playing surface, the element of chance still predominates to deny a payoff absent a coin falling off the preferred edge.

Because many states prohibit gambling, the payoff from an amusement device cannot be related to random chance; rather, it must predominately rely on skill. For this reason, any game providing a payoff, in order that it not be designated a gambling device, must necessarily include a relatively high correspondence between the skillful placement of coins and the payoff count.

Thus, it is the primary object of the present invention to provide an improved amusement device wherein is achieved a high degree of correspondence between skillful manipulation of deposited coins and the payoff amount.

SUMMARY OF THE INVENTION

The present invention relates to a coin pitch game of the mechanical kind which comprises a substantially rectangular exterior housing having a transparent upper surface, the housing being attached to ground around the bottom edges thereof. Included in the housing is an inwardly directed, articulated coin chute by which coins may be controllably deposited onto an interior surface formed on the top of an interior housing. The interior housing further includes a vertical dam extending thereacross, said dam being articulated by reciprocating means whereby to synchronously sweep back and forth across at least a portion of the interior surface.

As a sufficient number of coins are accumulated on said surface, certain numbers thereof will be pushed by the dam over the edge of said housing. These coins are then counted by mechanical or electrical means, and a corresponding count of payoff tokens or tickets dispensed to the player.

In order to achieve a higher degree of correspondence between the payoff amount and individual skill in positioning a coin upon the interior surface, a multiplicity of surface interruptions are provided upon said interior surface whereby to inhibit the random movement of accumulated coins thereon.

BRIEF DISCRIPTION OF THE DRAWINGS

DESCRIPTION OF THE PREFERRED EMBODIMENT

Figure 1:
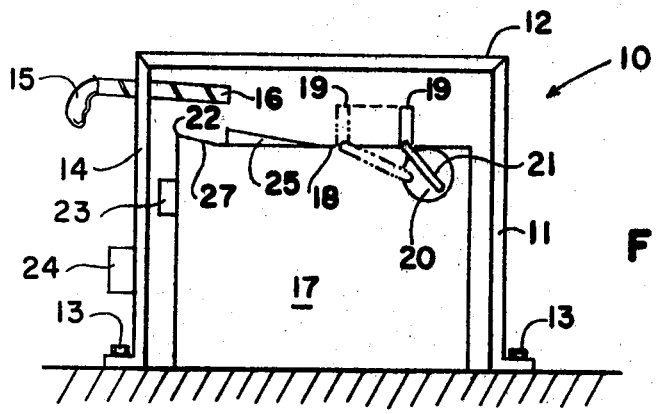
FIG. 1 is a side view in section of an amusement device constructed in accordance with the present invention.

So the my invention may be more readily understood, reference is now made to the several figures wherein like reference numerals refer to like parts throughout the several views.

As shown in FIG. 1, the amusement device 10 comprises an essentially rectangular exterior housing 11 having a transparent upper surface 12 permitting viewing into the interior thereof. Housing 11 thus provides the requisite side wall structure necessary to absorb exterior impacts, the side walls being secured to ground by a plurality of ground attachment fixtures 13. Disposed through at least one side wall 14 proximate transparent surface 12 is a gimbaled coin chute 15 extending through said side wall a distance sufficient to deploy the end 16 thereof over an interior housing 17 enclosed within said exterior housing 11 and structurally isolated therefrom.

More specifically, coin chute 15 is shaped in the manner of a narrow U-channel and aligned substantially in the vertical plane. The channel formed by chute 15 is manually articulable by the player whereby to permit deposition of a coin at a desired point upon the surface 18 of interior housing 17.

Interior housing 17 beneficially comprises a substantially flat horizontal surface 18 over which a dam 19, aligned vertically on its edge, is synchronously translated by any conventional reciprocating means. For example, said means may comprise an electrically powered motor (not shown) continuously rotating a crank 20, and a push rod 21 cooperating with dam 19 at each terminal end thereof. The dimensions of crank 20 and push rod 21 are selected to limit the translation of dam 19 such that dam 19 sweeps over less than the full area of surface 18.

Accordingly, as the course of play progresses, sufficient numbers of coins are accumulated upon the unswept area of surface 18 to a point where each additionally played coin, when laid flat within the swept area, will result in the passage of one or more coins over edge 22. These coins fall into a trough 23 formed on the lateral surface of housing 17 proximate edge 22. When dropped in trough 23, the coins will be counted by any conventional electrical or mechanical counting means (not shown), and a corresponding number of tokens or tickets will be paid out to the player through payoff gate 24.

Figure 2:
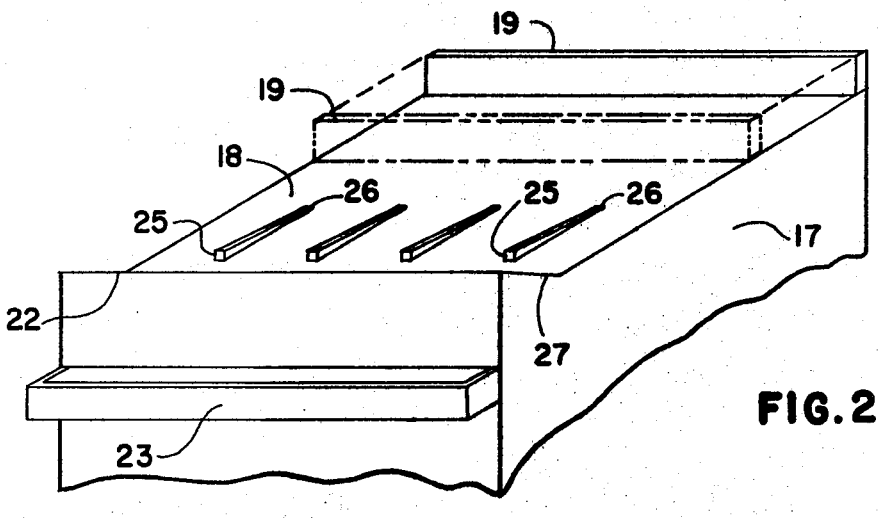
FIG. 2 is a perspective view of the interior housing more fully illustrating the multiplicity of surface interruptions secured thereon.

In order to more fully exploit the difference in skill levels between different players, surface 18 further beneficially comprises a multiplicity of surface interruptions secured upon the unswept area of surface 18. As shown in FIG. 2, said interruptions are preferably in the form of a beveled weir dam 27 integral to surface 18 and terminating at one end thereof as edge 22, and a multiplicity of wedge-shaped members 25 visible to the player. Said members 25 are aligned substantially perpendicular to edge 22 and parallel to each other, members 25 further being directed so that their tapered ends 26 are towards dam 19. Thus configured, members 25 serve to create troughs therebetween whereby to cause uni-directional movement of the accumulated coins (FIG. 3) towards edge 22.

Figure 3:
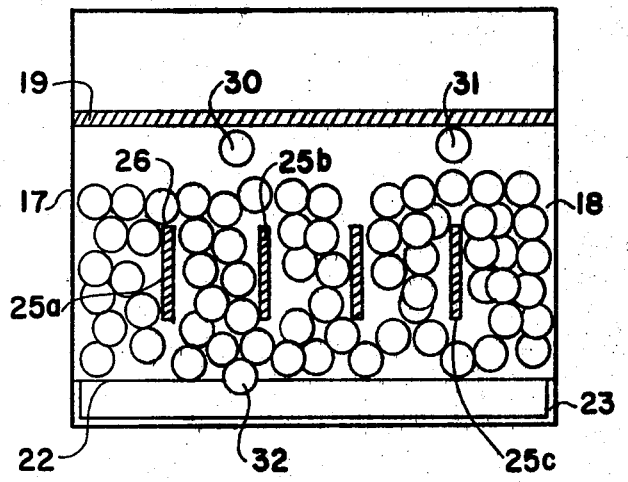
FIG. 3 is an elevational view of the interior housing shown in FIG. 2, a random pattern of coins being distributed thereon.

So that the operation of my invention may be more readily understood, FIG. 3 shows an elevational view of the interior housing 17 shown in FIG. 2, further having a random patter of coins distributed thereon. It is to be appreciated that the coins distributed thereon. It is to be appreciated that the coins distributed through the trough formed by members **25*a* and 25*b* are in substantially contiguous contact. Thus, a skillfully positioned coin 30 forced against such pattern has a high probability of success for causing coin 32 to fall over edge 22 and into the trough 23. In contrast, a coin 31 forced against the stacked pattern adjacent member 25*c* will cause said pattern to further stack, thereby resulting in little, if any, pattern movement towards edge 22**.

In the manner here before described, an amusement device is formed wherein the player has substantial control over the eventual placement of coins on the playing surface. Of course, it is to be appreciated that various random geometries of accumulated coins are formed upon the playing surface, and that certain of these random geometries are more conducive than others for removing coins therefrom. Thus, a player skilled in understanding such geometrical relationships will be able to consistently receive a correspondingly higher payoff of tokens or tickets than will a player having lesser abilities.

While a preferred embodiment of my invention has been described herein, it is to be appreciated that various changes, modifications, and rearrangements can be made therein without departing from the scope and essence of the invention as defined in the appendant claims. Thus, to the extent such changes, modifications, and rearrangements can be made, they are considered to be with the essence and scope of my invention.

What is claimed is:

1. An amusement device, comprising:

(a) a substantially rectangular, hollow first housing secured to ground and having a transparent surface at the top thereof;

(b) a substantially rectangular second housing supported on ground and isolated within the interior of said first housing, said second housing having an upper surface horizontally aligned subjacent said transparent surface;

(c) a dam deployed to synchronously translate over at least a portion of said upper surface;

(d) manually articulated coin-dispensing means pivotally extending through at least one lateral surface of said first housing for controllably guiding the passage of said coins to said upper surface;

(e) coin receiving means formed on at least one lateral surface of said second housing for collecting such coins as are pushed over an edge of said upper surface by said dam and for producing sensing signals indicative thereof;

(f) dispensing means mounted on said first housing and connected to receive said sensing signals for dispensing a number of tokens or tickets corresponding to the number of coins sensed; and (g) surface interruption means secured to said upper surface whereby to cause substantially uni-directional movement of accumulated coins thereon.

2. A device as defined in claim 1 wherein said dam further includes reciprocating means for synchronous translation thereof over said upper surface.

3. A device as defined in claim 1 wherein said surface interruption means comprises a multiplicity of wedge-shaped members aligned substantially parallel to each other and perpendicular to said dam, said members being secured whereby their tapered ends are directed towards said dam.

4. A device as defined in claim 3 wherein said surface interruption means further comprises a beveled weir dam integral to said upper surface and terminating at one edge thereof.

* * * * *